US008080949B2

(12) United States Patent
Cheng et al.

(10) Patent No.: US 8,080,949 B2
(45) Date of Patent: Dec. 20, 2011

(54) HID BALLAST WITH INTEGRATED VOLTAGE MULTIPLIER AND LAMP TEMPERATURE COMPENSATION

(75) Inventors: Ka Wai Eric Cheng, Kowloon (HK); Bangalore Prabhakar Divakar, Kowloon (HK); Dao Hong Wang, Kowloon (HK); Chow Norbert Cheung, Kowloon (HK)

(73) Assignee: The Hong Kong Polytechnic University, Hung Hom, Kowloon (HK)

( * ) Notice: Subject to any disclaimer, the term of this patent is extended or adjusted under 35 U.S.C. 154(b) by 501 days.

(21) Appl. No.: 12/382,081

(22) Filed: Mar. 9, 2009

(65) Prior Publication Data

US 2009/0251076 A1 Oct. 8, 2009

Related U.S. Application Data

(60) Provisional application No. 61/064,497, filed on Mar. 10, 2008.

(51) Int. Cl.
*G05F 1/00* (2006.01)

(52) U.S. Cl. ..... 315/309; 315/307; 315/291; 315/224; 323/242; 323/288

(58) Field of Classification Search ..... 315/209 R, 315/219, 247, 291, 224, 289, 307, 309; 323/207, 323/222, 242, 288

See application file for complete search history.

(56) References Cited

U.S. PATENT DOCUMENTS

| | | | | |
|---|---|---|---|---|
| 4,914,356 | A * | 4/1990 | Cockram | 315/307 |
| 7,187,136 | B2 * | 3/2007 | Fiorello | 315/224 |
| 7,221,107 | B2 * | 5/2007 | Melis | 315/291 |
| 7,911,148 | B2 * | 3/2011 | Fischer et al. | 315/219 |

OTHER PUBLICATIONS

Ron Fiorello, Power A 35W DC Metal Halide High Intensity Discharge (HID) Lamp Using the UCC3305 HID Lamp Controller, May 17, 1996.

Lee and Cho: Design and Analysis of Automotive High Intensity Discharge Lamp Ballast Using Micro Controller Unit, IEEE Transactions on Power Electronics, vol. 18, No. 6, Nov. 2003.

* cited by examiner

*Primary Examiner* — Haiss Philogene

(57) ABSTRACT

The present invention relates to temperature compensation of HID lamps in automobiles. The invention concerns the manner in which the temperature of the HID lamp is accounted for in order to drive the lamp is at appropriate power from hot to cold conditions. In the present invention, the voltage across a capacitor in the temperature compensation circuit is sensed and used as a command signal to anticipate lamp temperature, and accordingly the reference power to the HID lamp is modulated depending on the temperature of the lamp. In the present invention, the lamp is driven with a higher power setting when the lamp is cold and with lower power setting when hot. This adaptive generation of reference power setting depending on the temperature of the lamp is implemented using the voltage across a capacitor in the temperature compensation circuit.

7 Claims, 7 Drawing Sheets

HID BALLAST WITH INTEGRATED VOLTAGE MULTIPLIER AND LAMP TEMPERATURE COMPENSATION

CROSS REFERENCE TO RELATED APPLICATION

The present application claims priority from U.S. Provisional Patent Application No. 61/064,497 filed on Mar. 10, 2008, which is hereby incorporated by reference herein in its entirety.

BACKGROUND OF THE INVENTION

1. Field of the Invention
2. Description of the Related Art

High intensity discharge (HID) lamps show superior performance over conventional halogen lamps, such as energy saving, long life, high luminous efficacy, and good color rendering. So, HID lamps will be the preferred lighting source in the near future. Unlike incandescent lamp, HID lamps do not contain filament and hence have longer life. On the other hand, the characteristics of an HID lamp are complex compared to that of a halogen lamp.

FIG. 1 shows the block diagram of conventional microprocessor-based HID ballast. The HID ballast circuit consists of DC/DC converter 101, voltage doubler 102, DC/AC inverter 103, the high voltage igniter 104, and controller 105 including microprocessor. The DC-DC converter 101, as the battery source in automotive systems use mostly 12 V, the DC/DC converter 101 should boost the battery voltage from 9-16V up to 300 V (dc-link voltage). For the voltage doubler 102, in order to step up the dc link voltage of 300V to about 600V required for the spark gap in the igniter assembly, the dc-dc converter 101 along with a voltage doubler 102 boost the dc-link voltage to 600V. For example, as taught in Lee and Cho ("Design and analysis of automotive high intensity discharge lamp ballast using micro-controller unit" (IEEE transactions on Power Electronics)), the voltage doubler 102 is formed by the additional winding on the secondary of a DC-DC converter transformer 101.

Regarding the use of the voltage doubler 102, as the breakdown voltage of the spark-gap used in the igniter assembly is about 600 V, the dc link voltage has to be of the same value. In order to reduce the dc link voltage, the circuit in Lee and Cho, uses a transformer with two secondaries with equal number of turns. The general schematic of the arrangement is shown in FIG. 3. The voltages across the two secondary windings are summed and applied to the spark gap. As a result the dc link voltage is reduced to 300 V. The limitation of this design is that two secondary windings are required resulting in larger size for the transformer.

The present invention is related to further reducing dc link voltage to 200 V from 300 V as in FIG. 1 and to eliminate the additional winding on the dc-dc converter transformer.

FIG. 2 shows an igniter assembly of the conventional HID ballast. The igniter is a high voltage transformer which converts the low voltage from the dc converter into a high-voltage pulse of 10-22 kV magnitude for initiating an arc across the lamp electrodes. The voltage from the voltage doubler is applied to the primary windings of the igniter through a capacitor and a spark gap arrangement. The spark gap conducts when the voltage across the capacitor is equal to the breakdown voltage (about 600 V) of the spark gap. The capacitor discharges its energy through the spark-gap into the primary when the spark gap conducts to create a pulse in the primary winding. This discharge pulse in the primary is amplified by the secondary winding and applied across the lamp.

The inverter of the conventional ballast is used to provide an alternating square pulses to the lamp upon ignition. The inverter has no active role in the control of power to the lamp.

The most important and complex part of the conventional ballast is the controller which controls and dictates the mode of operation depending on the stages from the start-up to steady state. The operating mode of the controller changes from constant current mode at start-up to constant power mode after the lamp voltage begins to increase. In order to satisfy the standards, the lamp is driven at twice the rated power at start-up but with the maximum load current limited to around 2.5 A.

Unlike HID lamps for other applications, the HID lamps for automobiles must develop over 70% of the light output within 2 seconds of being turned on under cold and warm start conditions. The controller of an electronic ballast ensures that the lamp receives appropriate power under all conditions. The parameter that affects the characteristics of HID lamps is the lamp temperature which influences the power required by the lamp for successful operation. As the power demanded by the lamp at different stages of operation is dependent on the lamp temperature it is vital to use the lamp temperature as one of the feedback signals to calculate the reference power signal with which to drive the lamp.

In Fiorello's "Powering a 35 W DC metal halide high intensity discharge (HID) lamp using the UCC3305 HID lamp controller" (Unitrade Corporation), a method is proposed to monitor the temperature of the lamp in which a capacitor is charged by a variable current source and the voltage of the capacitor is measured to reflect the temperature of the lamp. The lamp temperature is estimated based on the voltage of this capacitor. The current source charges the capacitor at different rates till the lamp achieves a steady state and the voltage of this capacitor is clamped at a certain value to indicate the steady state operation of the lamp. The design of the current source is complex and expensive besides it requires careful tuning of the magnitude to control the rate of charging of the capacitor.

SUMMARY OF THE INVENTION

A method is therefore suggested in the present invention and accordingly, the lamp voltage is stepped down and used to charge the capacitor instead of a current source. The logic behind this principle is that the lamp temperature being proportional to the lamp voltage can be estimated if the capacitor is charged by a parameter (lamp voltage) that is a true representative of the temperature. In order to develop uniform light output under cold and warm states, a temperature compensating block is made use of in this invention. The output of the conventional circuit mimics the lamp temperature and is fed to the microcontroller which in combination with the data from the lamp current and lamp voltage generates a suitable reference power setting with which the lamp is driven.

According to an aspect of the present invention, the present invention improves the performance of the HID ballast for automobiles.

According to another aspect of the present invention, a voltage multiplier circuit may triple the voltage from the dc-link voltage to apply to the spark gap of an igniter assembly.

According to yet another aspect of the present invention, the invention eliminates the additional winding on a dc-dc converter transformer as exhibited by the prior art.

According to yet another aspect of the present invention, a method to provide temperature compensation in the design of the HID ballast circuit. Accordingly, the lamp voltage is suggested as a better source to charge a capacitor for monitoring the temperature instead of a current mirror circuit employed in the conventional system (see FIG. 2), which is expensive.

Through the present invention, advantages to HID ballast used in automobiles include the elimination of additional secondary windings, reduction in the size of the transformer owing to fewer turns ratio, and selection of devices with lower ratings as the dc-link voltage is reduced.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

The present invention will be described below with reference to the accompanying drawings.

In order for an HID lamp to operate properly, an HID ballasts must generate an adaptive reference signal to drive the lamp at appropriate power under cold and warm conditions. The present invention fulfills this requirement by designing a ballast with an integrated temperature compensation circuit.

A microprocessor receives a signal from the compensation circuit and from lamp current and lamp voltage sensors to generate suitable reference signal to the controller in the ballast. The electronic ballast can anticipate the lamp temperature with the information provided by the temperature compensation circuit to the microcontroller and provide appropriate energy to the lamp at different states.

In the present invention the voltage across a capacitor is monitored and modeled to reflect the temperature of the lamp. The voltage on the capacitor is changed according to the condition of the lamp such that the capacitor begins to charge when the lamp is on and discharge when the lamp is off. In this regard, the controller controls charging and discharging of this capacitor to reflect the change in temperature of the lamp. As the lamp voltage is a function of temperature, the capacitor is charged with a voltage proportional to the lamp voltage resulting in higher charge voltage for higher temperature and vice versa.

The fall in temperature of the switched off lamp is modeled by the controlled discharge of this compensating capacitor. A microcontroller senses the voltage across the its capacitor and utilizes it to operate on the inputs from the lamp voltage and lamp current sensors. The resultant signal is the suitable reference power setting with which the lamp is to be driven to generate proper light output. By this way, the electronic ballast is made to anticipate the lamp temperature and provide compensation for the change in lamp voltage under cold and warm conditions. The compensating capacitor is fed by a voltage proportional to the lamp voltage resulting in proper correlation between the capacitor voltage and the lamp temperature.

Figure 4:
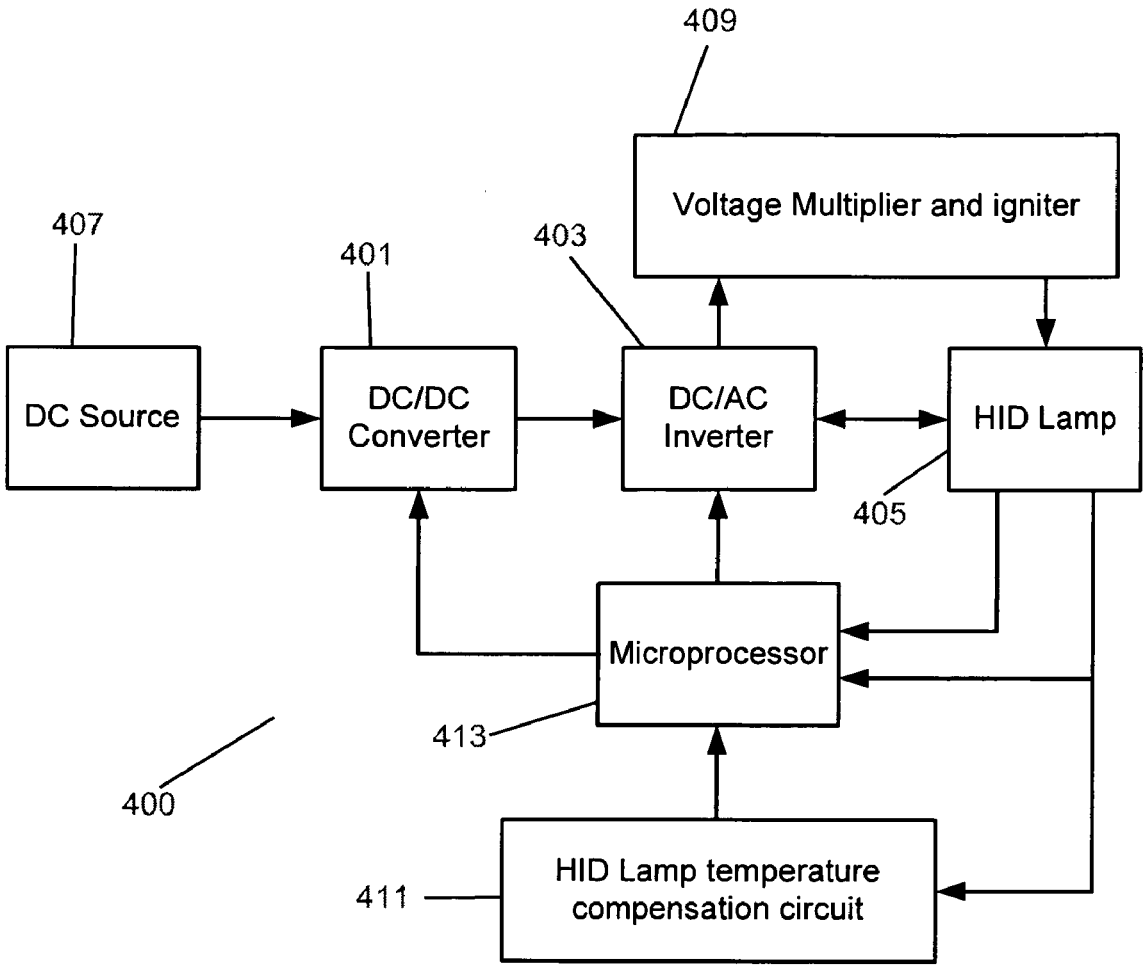
FIG. 4 shows an exemplary block diagram of the microprocessor-based HID ballast of the present invention.

FIG. 4 shows an exemplary block diagram of the microprocessor-based HID ballast 400 of the present invention. The HID ballast circuit consists of DC/DC converter 401, DC/AC inverter 403, the high voltage igniter 409 and controller including microprocessor 413. Because the DC source 407 such as a battery in automotive system presently uses mostly 12V, the DC/DC converter 401 should boost the battery voltage (9-16V) up to the HID lamp voltage for the inverter input. The DC/AC inverter 403 drives the HID lamp 405 at steady state. THE DC/DC converter 401 boosts input voltage up to the breakdown voltage of the spark gap, and then the lamp 405 is ignited by the high voltage generator. The control circuit 411 is to provide a suitable timing control, voltage, power, and current required by the lamp 405.

The conventional HID lamps require a voltage pulse of 10 kV across its electrodes to start the ignition on cold, where as this voltage may go up to 22 kV when the lamp is hot. The cold resistance upon ignition is lower than that of the hot lamp. Another difference between the cold start and warm start is the time needed for the lamp to reach steady state after the lamp is ignited. Under cold start, the lamp is driven at constant current of 2 A after ignition to generate the required light output. After this mode, the lamp enters a warm-up mode in which the voltage of the lamp begins to increase and the lamp current begins to decrease because of constant power control. The rise of lamp voltage and fall of lamp current continues until steady state at which the two quantities become constant. When the same map is ignited when hot, the lamp quickly enters into the steady state upon ignition without spending time in the warm-up mode. The voltage of a lamp after ignition is a function of temperature of the lamp and it determines the power consumed by the lamp after the ignition as well as the light output. Hence, the cold and hot start of lamps presents different conditions and so, the ballast has to be equipped with some feature to account for the effect of temperature. The electronic ballasts, therefore, must have the capability to anticipate the state of the HID lamp and generate appropriate reference power signal depending on the temperature of the lamp. Otherwise, the lamp will be driven at different power settings at cold and warm conditions resulting in dissimilar light output under cold and warm conditions.

Figure 5:
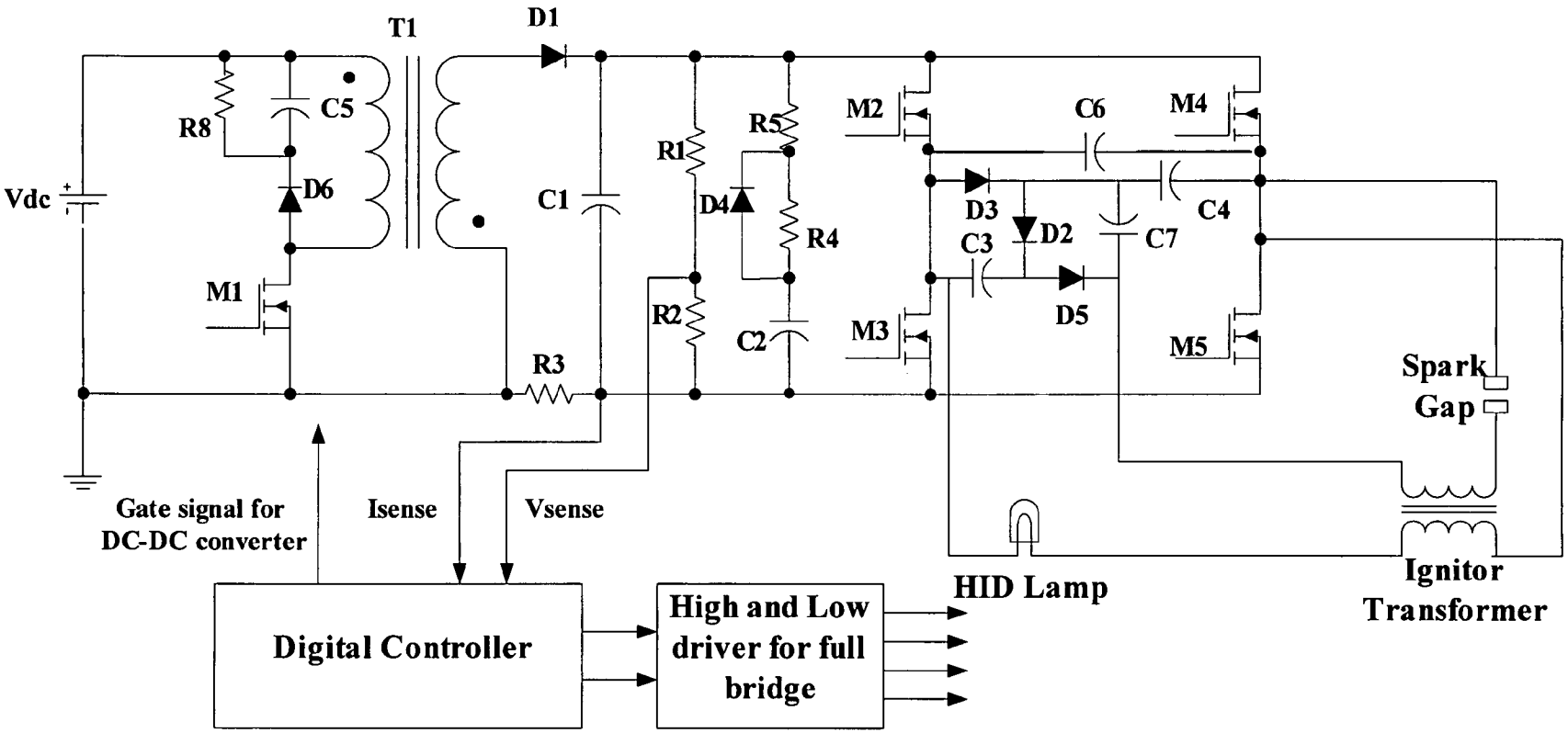
FIG. 5 illustrates an exemplary schematic of the ballast showing the connection of the proposed voltage multiplier circuit.

The detailed schematic of the ballast showing the connection of the proposed voltage multiplier circuit (enclosed in the box) is shown in FIG. 5.

To start with the lamp acts as an open circuit and hence there is no current through the lamp. The DC-DC converter steps up the input voltage and applies to the inverter circuit. As the inverter (formed by M1, M2, M3 and M4) begins to operate, the voltage multiplier (formed by D3, C3, D2, C3, D5 and C7) multiplies the dc-link voltage in stages until the voltage across the spark gap in the igniter assembly is about 600 V.

Stage 1) When the inverter switches M2 and M5 are on: The current flows through D3 and C4

Stage 2) When the inverter switches M4 and M3 are on: The current flows through C4, D2 and C3 and C3 is charged to the voltage $VC3=V_{dc\text{-}link}+VC4$ Stage 3) In the subsequent stages, D1 and D3 conduct together to charge C7 with the voltage equal to VC7=VC4 whenever M2 and M5 are on.

As can be seen the voltages across C3 and C7 are added and applied to the spark gap in the igniter assembly.

Under steady state, $VC3=V_{dc\text{-}link}$ and $VC7=2V_{dc\text{-}link}$, with the result that the voltage applied to the spark gap is $=VC3+VC7=3\ V_{dc\text{-}link}=600$ V.

Figure 1:
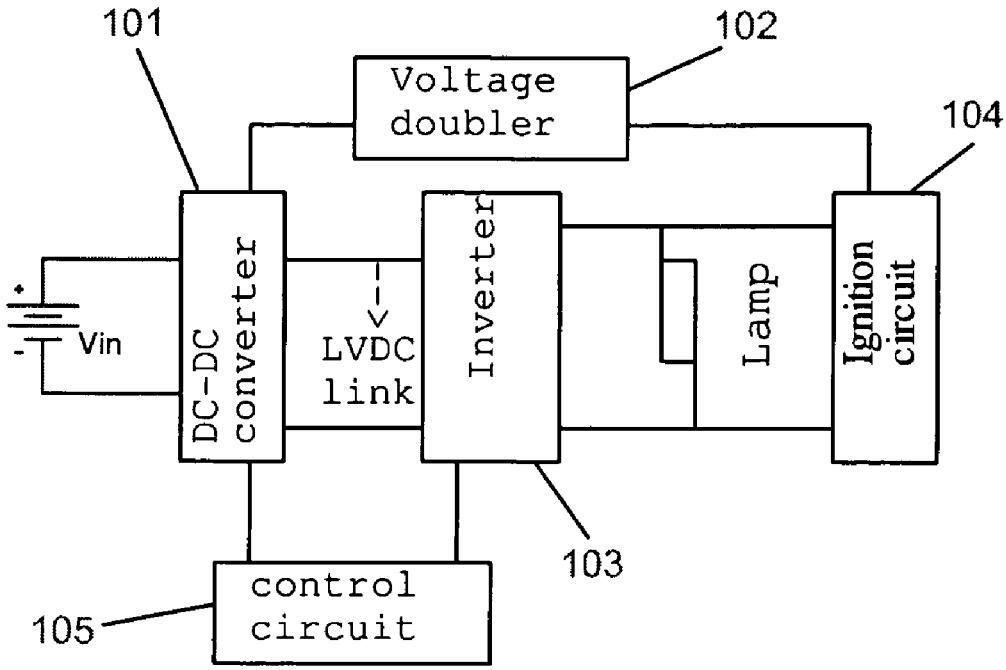
FIG 1 PRIOR ART
FIG. 1 shows the block diagram of conventional microprocessor-based HID ballast.
Figure 2:
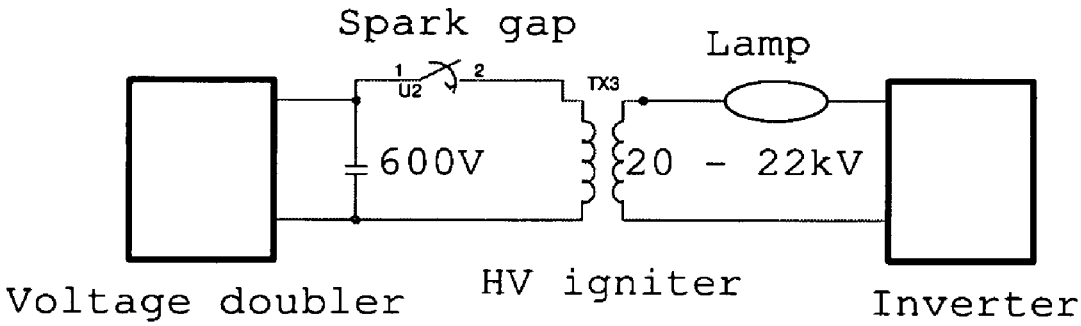
FIG 2 PRIOR ART
FIG. 2 shows an igniter assembly of the conventional HID ballast.
Figure 3:
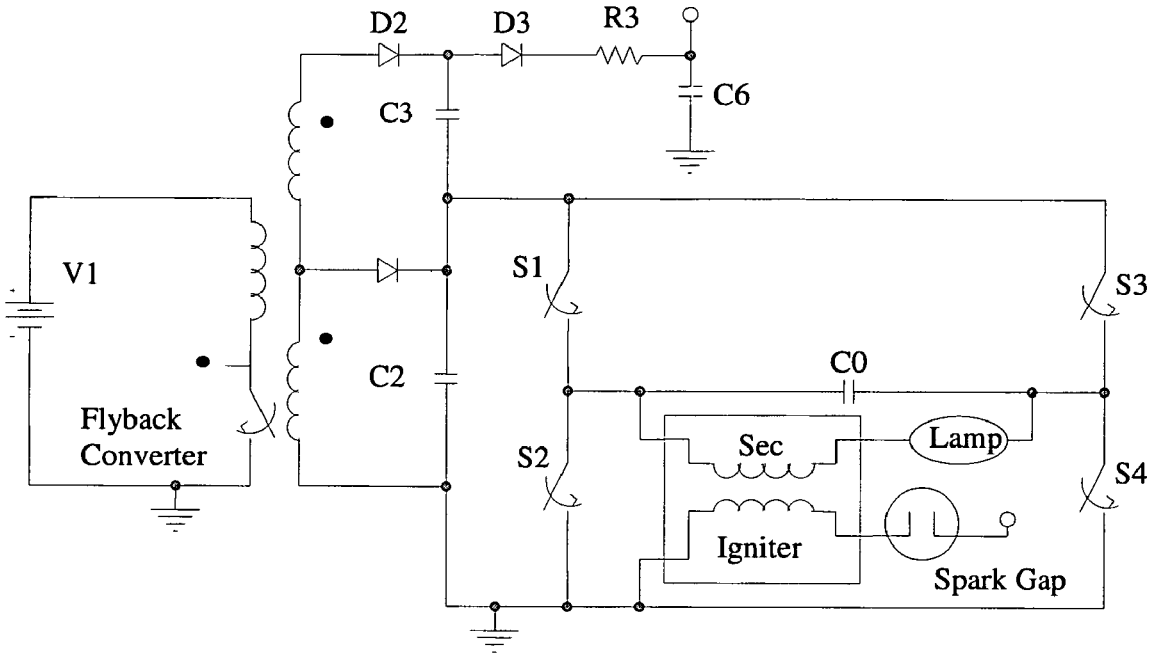
FIG 3 PRIOR ART
FIG. 3 shows a general schematic of the conventional HID ballast.

From the above equation, the dc-dc converter needs to develop only 200 V (as against 300 V in FIG. 1) to apply 600 V to the spark gap.

Figure 6:
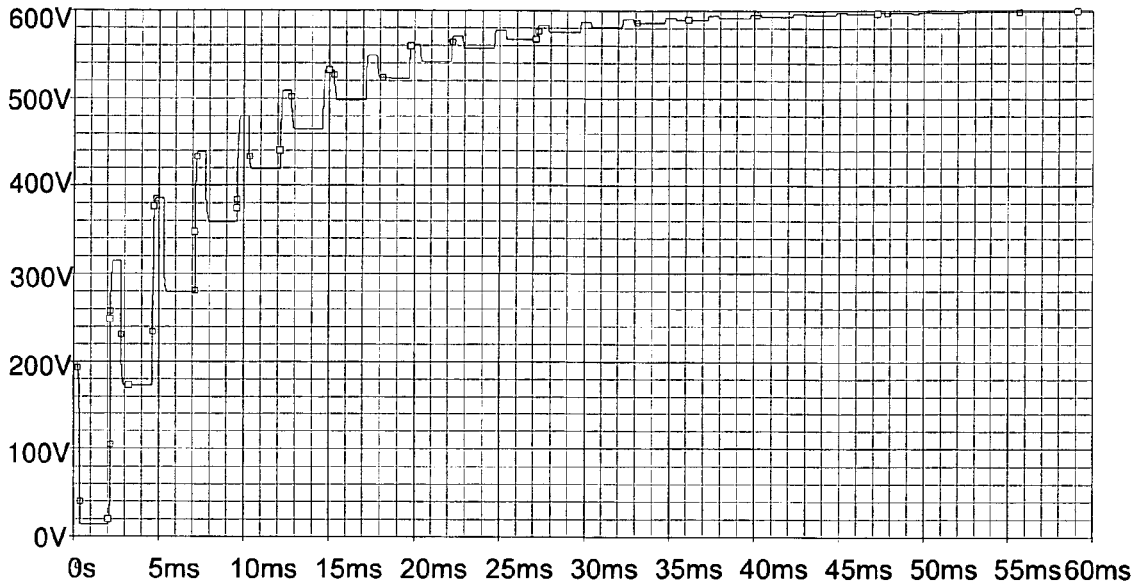
FIG. 6 shows a simulation result of the voltage tripler circuit.

The simulation result of the voltage tripler circuit is shown in FIG. 6 to verify the operation of the voltage multiplier to generate 600 V with the input dc-link voltage of 200 V.

When the voltage across the spark assembly is about 600 V, the spark gap conducts resulting in the generation of a pulse across the primary of the igniter transformer. The pulse is amplified to several kV on the secondary side to ignite the lamp.

The use of voltage multiplier circuit on the inverter side causes reduction in the dc-link voltage by about 100 V thus permitting fewer turns ratio for the dc-dc transformer.

Figure 7:
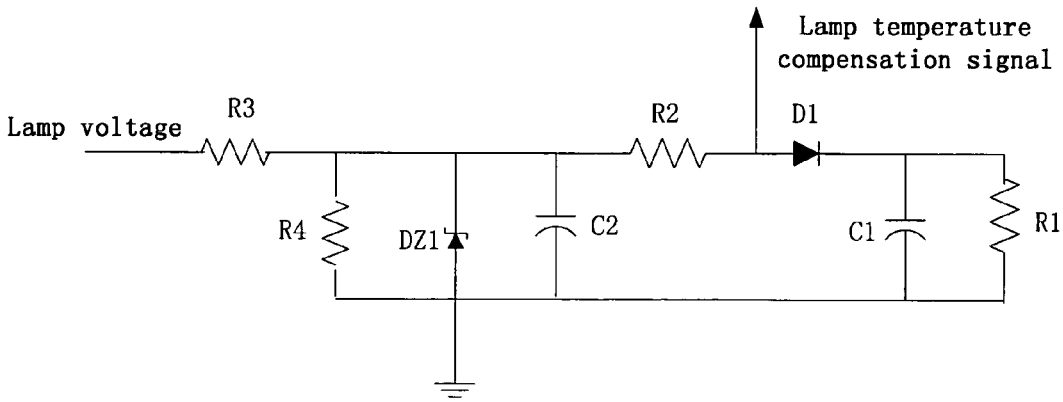
FIG. 7 shows an exemplary schematic of a HID temperature compensation circuit, formed by R3, R4, zener diode, C2, R2, D1, C1 and R1.

FIG. 7 shows an exemplary schematic of a HID temperature compensation circuit, formed by R3, R4, zener diode, C2, R2, D1, C1 and R1.

From the above discussion it is clear that the lamp voltage is a function of the lamp temperature and that the voltage of the cold lamp decreases after ignition before increasing to the steady state value. On the other hand, the voltage of the lamp under very hot condition (as in lamp that is ON for a long time) reaches the steady state without any delay. For any other conditions falling between cold and very hot conditions the lamp voltage will rise to the steady state after ignition with a delay time which is a function of the lamp temperature. The lamp voltage being a function of lamp temperature forms a proper signal to estimate the lamp temperature in order to drive the lamp with appropriate power.

FIG. 7 shows the schematic of the proposed temperature compensation circuit that mimics the temperature of the lamp. C1 is the capacitor whose voltage is monitored to estimate the lamp voltage. The Lamp voltage is stepped down via a voltage divider formed by $R_3$ and $R_4$ and used to charge C1 via C2, R2 and D1.

The voltage across C1 is sensed by the microcontroller to generate the reference power setting. For a cold lamp, no or less energy is stored in capacitor C1 and therefore the microprocessor generates a higher power reference setting to drive the lamp at higher power output. As the lamp warms up, the lamp voltage and lamp temperature increases until steady state is reached. At the same time the voltage across the compensating capacitor C1 follows the lamp voltage forcing the microcontroller to adjust the reference power setting at which the lamp is being driven. Hence the reference power setting calculated by the microprocessor is inversely proportional to the charge on C1. As a result, the microprocessor gradually reduces the power setting from its maximum value until steady state in which the lamp will be driven at 35 W.

After the lamp is turned off the lamp temperature falls slowly and this is mimicked by the discharge of the voltage across C1 through R1. As the reference power setting with which the lamp is driven during the next switch on is dependent on the lamp temperature, it is important to select the value of R1 to match the rate of discharge of C1 to the rate of fall of the lamp temperature.

For a hot lamp, more energy is stored in capacitor C1 (because of charge from the previous operation). Since the time taken by the lamp to reach the steady state is shorter under hot condition compared to the time under cold condition, the microcontroller adjusts the new power setting to a value less than that required under cold start.

Figure 8:
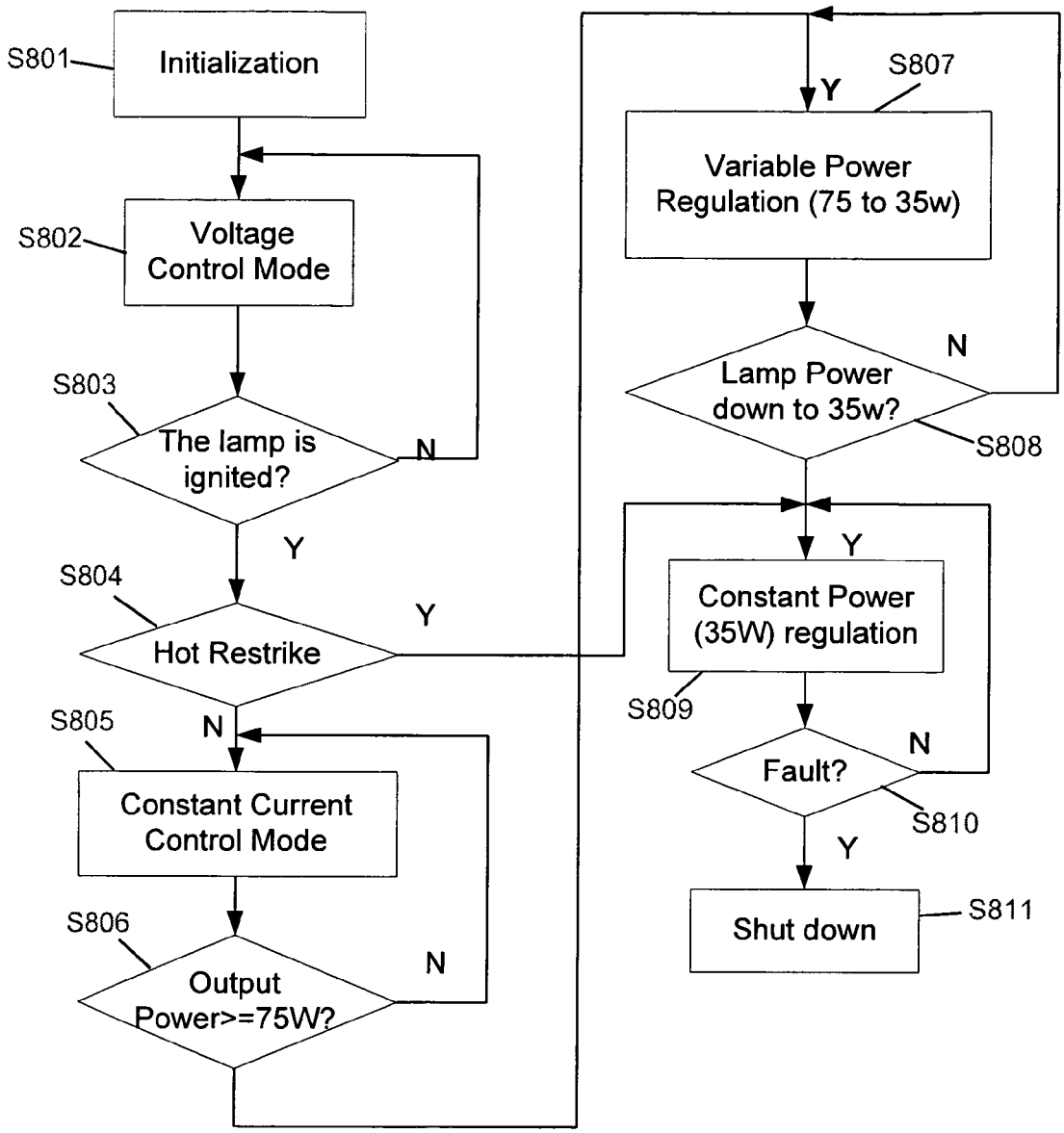
FIG. 8 shows an exemplary flow chart of the control program for the microcontroller.

FIG. 8 shows an exemplary flow chart of the control program for the microcontroller. The lamp undergoes four different control modes (voltage control mode (S802), constant current control mode (S805), variable power regulation (S807), constant power regulation (S809)). The key to successful software control is in identifying the transition points in the operation of the lamp from the ignition stage to the steady state.

Upon initialization in step S801, the voltage output of the DC-DC converter is to be boosted prior to ignition and so, voltage control mode (step S802) is adopted in this stage. Once the lamp is ignited (Yes in step S803), the HID ballast must provide enough high current to the lamp in order to maintain the arc (Yes in step S804). So, constant current control mode (step S805) is adopted to maintain constant current in this stage. When the lamp power reaches 75 w (Yes in step S806), control mode enters into the variable power mode (step S807) resulting in the power being reduced gradually. The reduction in the power output is due to the voltage across the temperature compensating capacitor C1 which is being charged with the increasing lamp voltage. Finally, when the lamp power decreases to 35 w (Yes in step S808), the mode enters into steady state in which the lamp is driven at a steady power of 35 W. In a case a fault occurs (step S810), the microcontroller would instruct the lamp to shut down.

Figure 9:
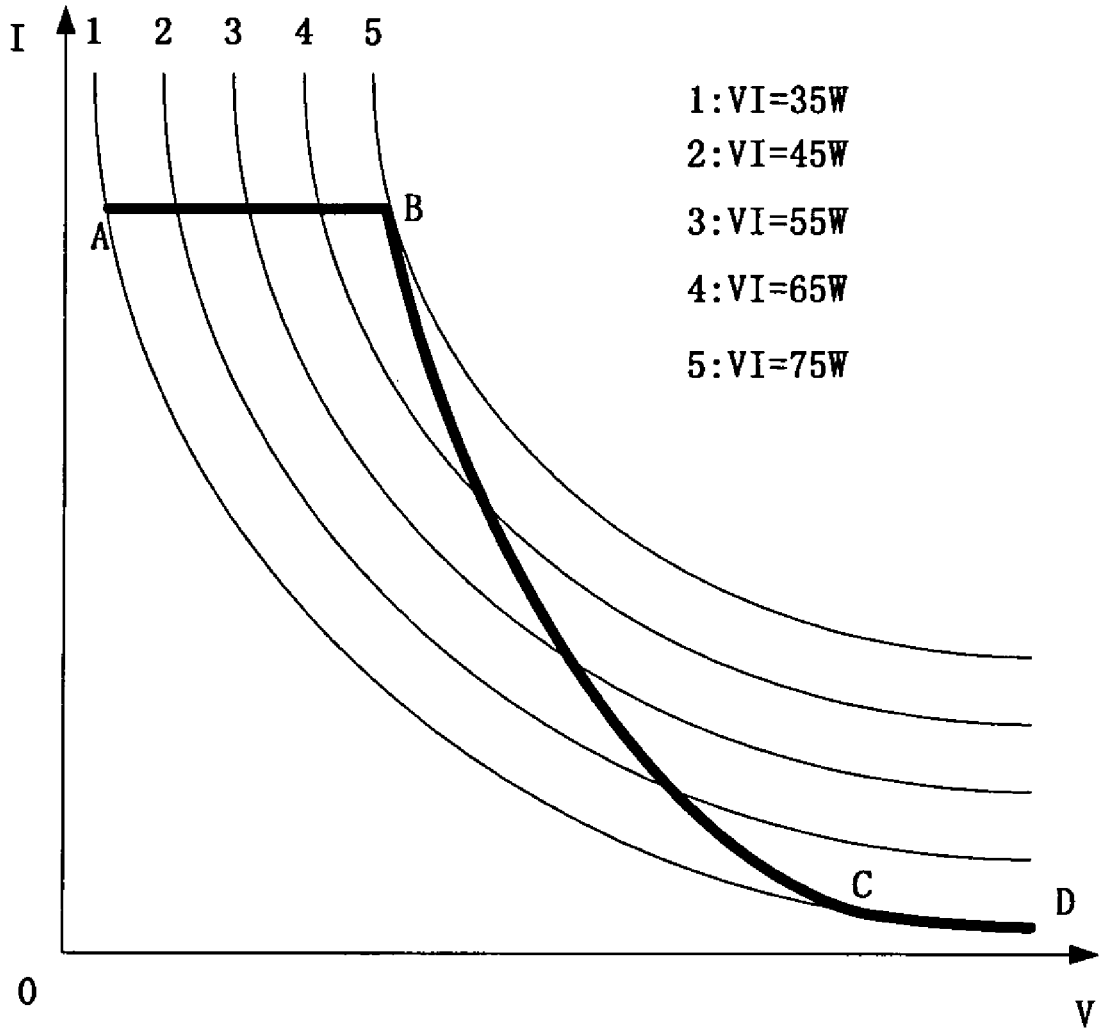
FIG. 9 shows the power regulation curve during different stages of lamp operations.

FIG. 9 shows the power regulation curve during different stages of lamp operations: current feedback control stage (A-B), Variable power regulation stage (B-C) and 35 w constant power regulation stage (C-D). Curve 1-5 represent curves at different power level. Constant Current mode (A-B): After ignition, HID lamp enters into constant current mode to limit excessive current into the lamp. During this mode the lamp reaches a peak power of about 75 W. Variable power regulation (75 w to 35 w) mode (B-C): Curve B-C shows variable power regulation which is due to the temperature compensation capacitor C1 as mentioned before. Constant power at 35 W regulation mode (C-D): This is when the lamp power enters into steady state value of about 35 W.

The present invention may be executed by computer-executable program that is stored on a computer-readable medium. In addition, the program read out from the recording medium may be written in a function expansion board inserted into a computer or in a memory provided for a function expansion unit connected to a computer. Subsequently, a CPU included in the function expansion board or the function expansion unit performs a part of or all of the processing in accordance with the instruction of the program, whereby the functions of the above-described embodiments can be achieved.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A lamp ballast for driving a lamp depending on temperature of the lamp, comprising:

a temperature compensation circuit configured to charge a compensating capacitor with lamp voltage, and transmit a compensating signal based on the compensating capacitor's voltage; and a processing unit configured to receive the compensating signal from the temperature compensating circuit and drive the lamp based the received compensating signal.

2. The lamp ballast according to claim 1, wherein the processing unit can drive the lamp in a voltage control mode, a constant current control mode, a variable power regulation mode, or a constant power regulation mode.

3. The lamp ballast according to claim 1, further comprises a DC/DC converter, a DC/AC Inverter, and a voltage multiplier and igniter circuit.

4. The lamp ballast according to claim 3, wherein the voltage multiplier and igniter circuit triples the voltage from the DC/AC Inverter to be applied to a spark gap.

5. The lamp ballast according to claim 1, wherein the lamp includes a high-intensity discharge lamp.

6. A method for driving a lamp depending on temperature of the lamp, the method comprising:

charging, by a temperature compensation circuit, a compensating capacitor with lamp voltage and transmit a compensating signal based on the compensating capacitor's voltage; and receiving, by a processing unit, the compensating signal from the temperature compensating circuit and drive the lamp based the received compensating signal.

7. The method according to claim 6, wherein the processing unit can drive the lamp in a voltage control mode, a constant current control mode, a variable power regulation mode, or a constant power regulation mode.

* * * * *